US010449683B2

(12) United States Patent
Spencer et al.

(10) Patent No.: US 10,449,683 B2
(45) Date of Patent: Oct. 22, 2019

(54) RAZOR COMB HAIR TOOL

(71) Applicant: Litomi LLC, Carmel, IN (US)

(72) Inventors: Lillian Love Spencer, Indianapolis, IN (US); Thomas F. Foust, Carmel, IN (US); Garry Robin Marty, Fishers, IN (US); Maureen E. Carroll, Atlanta, GA (US); Stephen D. M. Jones, Sandy Springs, GA (US)

(73) Assignee: Litomi LLC, Carmel, IN (US)

( * ) Notice: Subject to any disclaimer, the term of this patent is extended or adjusted under 35 U.S.C. 154(b) by 0 days.

(21) Appl. No.: 15/688,550

(22) Filed: Aug. 28, 2017

(65) Prior Publication Data

US 2017/0355090 A1 Dec. 14, 2017

Related U.S. Application Data

(63) Continuation-in-part of application No. 14/708,754, filed on May 11, 2015, now abandoned.

(60) Provisional application No. 61/990,792, filed on May 9, 2014.

(51) Int. Cl.

| | |
|---|---|
| ***B26B 21/12*** | (2006.01) |
| ***A45D 24/36*** | (2006.01) |
| ***B26B 21/40*** | (2006.01) |
| ***B26B 21/52*** | (2006.01) |

(52) U.S. Cl.

CPC ..... *B26B 21/12* (2013.01); *A45D 24/36* (2013.01); *B26B 21/4006* (2013.01); *B26B 21/4018* (2013.01); *B26B 21/525* (2013.01); *B26B 21/527* (2013.01)

(58) Field of Classification Search

CPC .. A45D 24/36; A45D 24/10; A45D 2024/002; B26B 21/12; B26B 21/525; B26B 21/08; B26B 21/125; B26B 21/14; B26B 21/16; B26B 21/165; B26B 21/18;

(Continued)

(56) References Cited

U.S. PATENT DOCUMENTS

| | | | |
|---|---|---|---|
| 797,184 | A | 8/1905 | Deneen |
| 1,317,748 | A | 10/1919 | Zimmerman |
| 1,342,494 | A | 6/1920 | Zimmerman |

(Continued)

FOREIGN PATENT DOCUMENTS

| | | |
|---|---|---|
| CH | 298995 | 5/1954 |

OTHER PUBLICATIONS

From the International Searching Authority; Written Opinion dated Aug. 10, 2015; International application No. PCT/US2015/030168 filed May 11, 2015.

*Primary Examiner* — Phong H Nguyen

(74) *Attorney, Agent, or Firm* — Frost Brown Todd LLC; Dennis S. Schell

(57) ABSTRACT

A razor comb hair tool and a kit containing the same are disclosed. Embodiments include an elongated guard member having an exterior with first and second opposing edges and a hollowed interior defining a cavity, wherein the first edge includes a plurality of spaced apart comb teeth and the second edge includes an opening allowing access to the cavity. A razor blade may optionally be positioned within the cavity. Embodiments also include a handle member adapted along a first edge to make a slidable connection with the second edge of the guard member. When the slidable connection is made, access to the opening and/or razor blade is obstructed.

10 Claims, 16 Drawing Sheets

(58) Field of Classification Search
CPC ..... B26B 21/4006; B26B 21/4018; B26B 21/527
USPC ..... 30/30, 31, 53, 55, 75, 345.56, 300; 132/76.2; D28/25, 45
See application file for complete search history.

(56) References Cited

U.S. PATENT DOCUMENTS

| | | | | |
|---|---|---|---|---|
| 1,358,442 | A | | 11/1920 | Hasson |
| 1,382,377 | A | | 6/1921 | Muspratt |
| 1,385,280 | A | | 7/1921 | Coleman |
| 1,393,053 | A | | 10/1921 | Tillman |
| 1,401,915 | A | | 12/1921 | Mainwaring |
| 1,417,200 | A | | 5/1922 | Price et al. |
| 1,454,715 | A | | 5/1923 | Fontaine |
| 1,608,581 | A | | 11/1926 | Caruso |
| 1,634,788 | A | | 7/1927 | McGlashan |
| 1,693,973 | A | | 12/1928 | Alland |
| 1,789,234 | A | | 1/1931 | Keenan |
| 1,822,766 | A | | 9/1931 | Duffy |
| 1,918,636 | A | | 7/1933 | Duffy |
| 1,932,876 | A | | 10/1933 | Agostini |
| 1,975,328 | A | | 10/1934 | Madore |
| 1,976,290 | A | | 10/1934 | Motley |
| 1,977,933 | A | | 10/1934 | Agostini |
| 2,034,262 | A | | 3/1936 | Marrazzo |
| 2,067,619 | A | | 1/1937 | Perlson |
| 2,116,088 | A | | 5/1938 | Waite |
| 2,141,340 | A | | 12/1938 | Baumgarten |
| 2,152,898 | A | | 4/1939 | Madore |
| 2,180,834 | A | | 11/1939 | Marcel |
| 2,188,131 | A | | 1/1940 | Silberfeld |
| 2,252,628 | A | | 8/1941 | Good |
| 2,256,326 | A | | 9/1941 | Quinio |
| 2,288,299 | A | | 6/1942 | Pileggi |
| 2,431,270 | A | | 11/1947 | Mitchell |
| 2,461,444 | A | | 2/1949 | Sanders |
| 2,462,519 | A | | 2/1949 | Mansfield |
| 2,512,289 | A | | 6/1950 | Davis |
| 2,514,774 | A | | 7/1950 | Blanchet |
| 2,519,954 | A | | 8/1950 | Davis |
| D159,994 | S | * | 9/1950 | Lee ..... 30/30 |
| 2,536,485 | A | | 1/1951 | Behr |
| 2,562,421 | A | | 7/1951 | Hendra |
| 2,569,344 | A | | 9/1951 | Shaeffer |
| 2,580,276 | A | | 12/1951 | Borgerding |
| 2,589,230 | A | | 3/1952 | Davis et al. |
| 2,610,392 | A | | 9/1952 | Charbeneau |
| 2,615,244 | A | | 10/1952 | Mansfield |
| 2,623,277 | A | | 12/1952 | Lefebre |
| 2,624,937 | A | | 1/1953 | Ream |
| 2,636,261 | A | | 4/1953 | Shaeffer |
| 2,650,421 | A | | 9/1953 | Wietzel |
| 2,663,930 | A | | 12/1953 | Benedetti |
| 2,700,213 | A | | 1/1955 | Brody |
| 2,711,014 | A | | 6/1955 | Spanel |
| 2,722,739 | A | | 11/1955 | Davis et al. |
| 2,746,144 | A | | 5/1956 | Spanel |
| 2,791,829 | A | | 5/1957 | Gauthier |
| 2,810,953 | A | | 10/1957 | Brody |
| 2,814,865 | A | | 12/1957 | Sunich |
| 2,834,357 | A | | 5/1958 | Gould |
| 2,955,355 | A | | 10/1960 | Tornvall |
| 2,959,853 | A | | 11/1960 | Mercer |
| 2,967,354 | A | | 1/1961 | Ahlborn |
| 3,029,509 | A | | 4/1962 | Peters |
| 3,041,721 | A | | 7/1962 | Quinio |
| 3,384,960 | A | | 5/1968 | Solomon |
| 3,421,213 | A | | 1/1969 | Pawlikowski |
| 3,570,121 | A | | 3/1971 | Graceffo |
| 3,599,327 | A | | 8/1971 | Calandra |
| 3,699,653 | A | | 10/1972 | Miller |
| 3,805,381 | A | | 4/1974 | Broussard, Sr. |
| 3,855,696 | A | | 12/1974 | Spanel |
| 3,953,926 | A | | 5/1976 | Kallikounis |
| 3,990,461 | A | | 11/1976 | Katz |
| 4,009,517 | A | | 3/1977 | Horn |
| 4,011,656 | A | | 3/1977 | Liedtke |
| 4,020,549 | A | | 5/1977 | Edwards |
| 4,030,193 | A | | 6/1977 | Mandilaras |
| 4,037,322 | A | * | 7/1977 | Bresler ..... B26B 21/10 30/30 |
| 4,159,566 | A | | 7/1979 | Patrin |
| 4,344,226 | A | | 8/1982 | Blake, III |
| 4,401,129 | A | | 8/1983 | Luque |
| 4,505,283 | A | | 3/1985 | Pischdotchian |
| 4,614,032 | A | | 9/1986 | Szabo |
| 4,663,841 | A | | 5/1987 | Custer |
| 4,709,475 | A | | 12/1987 | Phung |
| 4,841,634 | A | | 6/1989 | Wang |
| 4,928,716 | A | | 5/1990 | Greene |
| 5,220,728 | A | | 6/1993 | Masayuki |
| 5,386,750 | A | | 2/1995 | Morrison |
| 5,461,780 | A | | 10/1995 | Morana |
| 5,479,950 | A | | 1/1996 | Andrews |
| 5,519,939 | A | | 5/1996 | Smith |
| 5,794,348 | A | | 8/1998 | Scott |
| 6,058,608 | A | | 5/2000 | Wruck |
| 6,092,288 | A | | 7/2000 | Hidemi |
| 6,094,820 | A | | 8/2000 | Hidemi |
| 6,249,973 | B1 | * | 6/2001 | Hirano ..... B26B 21/12 30/30 |
| 6,397,472 | B1 | | 6/2002 | Kumar |
| D484,769 | S | | 1/2004 | Cheung |
| 6,807,736 | B2 | | 10/2004 | Langley |
| 7,073,262 | B2 | | 7/2006 | Melton |
| 7,243,428 | B2 | | 7/2007 | Hisao |
| 7,617,936 | B2 | | 11/2009 | Barnett, Jr. |
| 7,849,603 | B2 | | 12/2010 | Venzon |
| 7,918,029 | B2 | | 4/2011 | Melton et al. |
| 7,926,183 | B2 | | 4/2011 | Groh |
| 8,839,521 | B2 | | 9/2014 | Hazard |
| 2002/0157262 | A1 | | 10/2002 | Talavera |
| 2004/0084057 | A1 | | 5/2004 | Hisao |
| 2004/0237313 | A1 | | 12/2004 | Takanori |
| 2004/0250428 | A1 | | 12/2004 | Melton |
| 2006/0130334 | A1 | | 6/2006 | San |
| 2007/0137049 | A1 | | 6/2007 | Venzon |
| 2007/0151109 | A1 | | 7/2007 | Tsutomu |
| 2008/0005908 | A1 | | 1/2008 | Melton et al. |
| 2008/0066690 | A1 | | 3/2008 | Rosen |
| 2008/0078333 | A1 | | 4/2008 | Wang |
| 2008/0115735 | A1 | | 5/2008 | Wang |
| 2008/0235951 | A1 | | 10/2008 | Groh |
| 2009/0019700 | A1 | | 1/2009 | Shushan |
| 2009/0032043 | A1 | | 2/2009 | Gaugler |
| 2009/0139093 | A1 | | 6/2009 | Moreschini |
| 2009/0183376 | A1 | | 7/2009 | Wang |
| 2010/0071214 | A1 | | 3/2010 | Kinghorn |
| 2010/0287778 | A1 | | 11/2010 | Ronda |
| 2011/0131811 | A1 | | 6/2011 | Hirano |
| 2011/0146084 | A1 | | 6/2011 | Melton et al. |
| 2012/0192427 | A1 | | 8/2012 | Hazard |

* cited by examiner

RAZOR COMB HAIR TOOL

CROSS-REFERENCE TO RELATED APPLICATIONS

This application is a continuation-in-part of U.S. Non-provisional patent application Ser. No. 14/708,754, filed May 11, 2015, which claims priority to U.S. Provisional Patent Application No. 61/990,792, filed May 9, 2014.

TECHNICAL FIELD

The present disclosure relates generally to a hair tool, and more particularly to a hair tool including a comb portion which is adapted to receive a razor blade.

BACKGROUND

A razor comb is a hair-cutting and hair-shaping tool that typically has a handle longitudinally spaced from the razor blade and comb portion. These razor combs resemble, and are often mistaken for, conventional combs. Importantly, however, razor combs are adapted to receive a razor blade, often positioned such that a cutting edge of the razor blade extends between comb teeth, for creating texture in hair and/or thinning out thick, coarse hair during use. They can be employed on both humans and animals to achieve a variety of hair styles.

A portion of the razor comb, such as the comb portion, may receive or slide over the razor blade and the razor comb may include user access to allow the replacement of the razor blade. These and other currently available means for inserting and removing razor blades are difficult, dangerous, time-consuming, and unreliable. In addition, due to the positioning of the handle relative to the razor blade, it is often difficult to get precise control and accurate cutting lines using these conventional razor combs.

The present disclosure is directed to one or more of the problems or issues set forth above.

SUMMARY

In one aspect, a razor comb hair tool can include a razor blade, a blade guard, a retainer, and a handle. The blade guard can have first and second opposing edges, with the first edge of the blade guard defining a plurality of spaced apart comb teeth. The blade guard can have a position in which the razor blade is retained within the blade guard wherein a cutting edge of the razor blade is aligned with and extends between the spaced apart comb teeth. A first edge of the retainer can releasably receive the second edge of the blade guard. The handle can have first and second opposing edges. The first edge of the handle can receive the second edge of the retainer and the second edge of the handle can include a plurality of curved finger receiving contours.

In another aspect, a razor comb hair tool can include a razor blade, a blade guard, and a handle. The blade guard can have an exterior with first and second opposing edges and a hollowed interior defining a cavity, with the first edge of the blade guard defining a plurality of spaced apart comb teeth and the second edge including an opening allowing access to the cavity. The blade guard can have a position in which the razor blade is retained within the blade guard and a cutting edge of the razor blade is aligned with and extends between the spaced apart comb teeth. A handle member can be adapted along a first edge to make a connection with the second edge of the blade guard wherein the connection can obstruct access to the opening of the cavity.

The razor comb hair tool of the present disclosure can include additional features to provide additional functionality and greater ease of use for a user. For example, the first edge of the handle member can define a socket open along the first edge and a first end and closed on a second end, and the second edge of the guard member can define a tenon shaped to be slidably received by the socket to facilitate a practical sliding connection between the guard member and handle member. Further, the handle member can include a plurality of finger receiving contours, such as closed finger openings, to accommodate a user's hand. The hair tool can also include a curved protrusion used for separating hair.

In another aspect, a razor comb hair tool kit can include a razor blade, a set of blade guards, and a handle. Each blade guard can have a first edge defining a plurality of spaced apart comb teeth, with the blade guard having a position in which the razor blade is retained within the blade guard and a cutting edge of the razor blade is aligned with and extends between the spaced apart comb teeth. A profile of the spaced apart comb teeth of each blade guard in the set is different. The handle has first and second opposing edges. The first edge of the handle slidably receives a second edge of one of the blade guards and the second edge of the handle includes a plurality of curved finger receiving contours.

DETAILED DESCRIPTION OF THE ILLUSTRATED EMBODIMENTS

Figure 1:
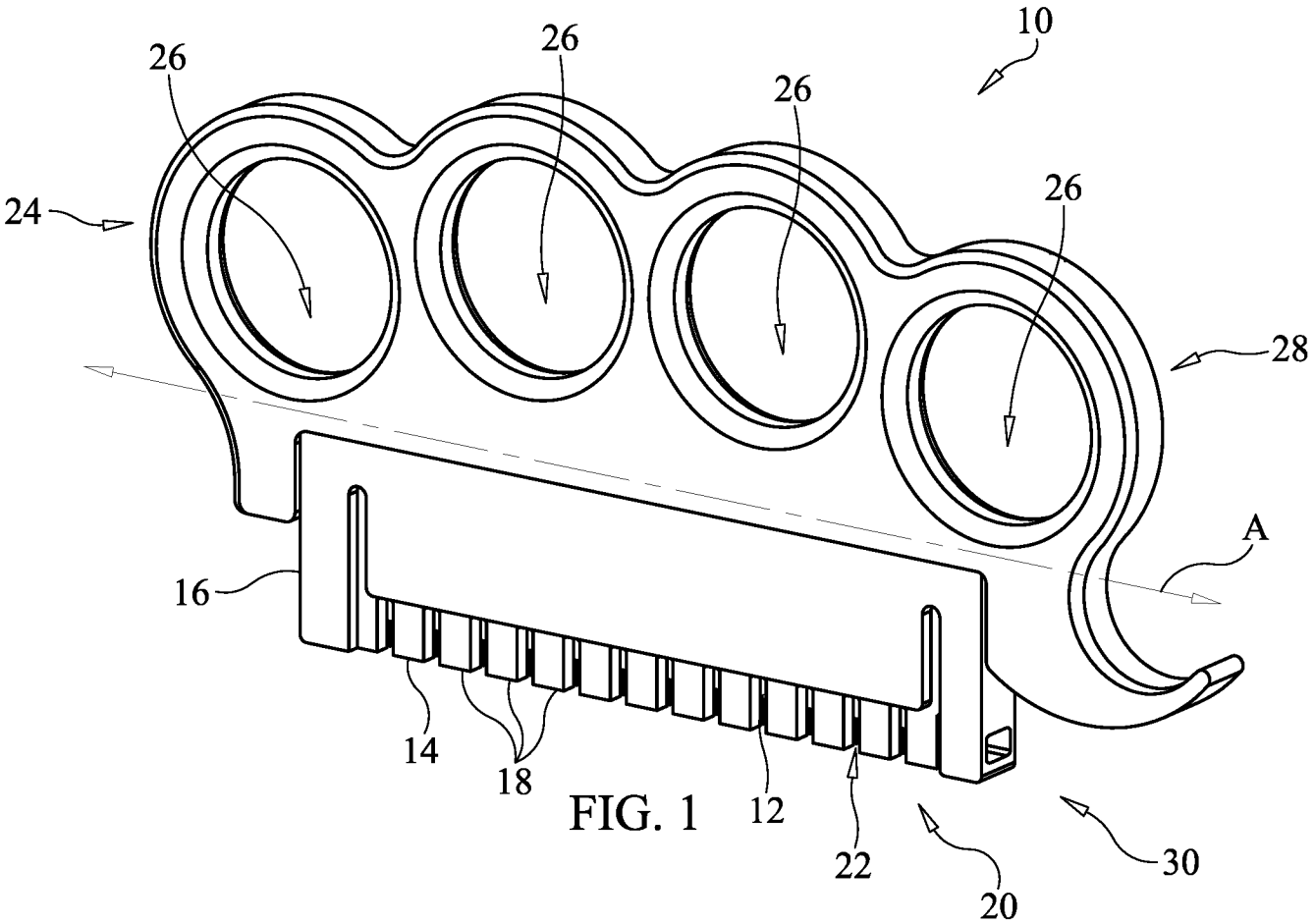
FIG. 1 is a perspective view of a first exemplary razor comb hair tool, according to the present disclosure.

FIG. 1 illustrates a first exemplary razor comb hair tool 10, according to the present disclosure. The razor comb hair tool 10 generally includes a razor blade 12, a blade guard 14, a retainer 16, and a handle 24, all shown in an assembled configuration. Although specific configurations are shown and described for each of the razor blade 12, blade guard 14, retainer 16, and handle 24, it should be appreciated that configurations of these components, including sizes, shapes, and features, may vary without deviating from the scope of the present disclosure. For example, each of the razor blade 12, blade guard 14, retainer 16, and handle 24 may be made from any known materials, selected for ease of manufacture and/or to enhance performance of the razor comb hair tool 10.

As will be described in greater detail below, the assembled configuration of the razor comb hair tool 10 includes the razor blade 12 retained within the blade guard 14, and the blade guard 14 releasably received by the retainer 16, and the retainer 16 received by or integral with the handle 24. Also in the assembled configuration, a plurality of spaced apart comb teeth 18, defined by an edge 20 of the blade guard 14, are exposed relative to the retainer 16. In addition, a cutting edge 22 of the razor blade 12 is aligned with and extends between adjacent ones of the spaced apart comb teeth 18. As shown, the cutting edge 22 may be receded relative to free tips or ends of the spaced apart comb teeth 18. In addition, the spaced apart comb teeth 18 may be evenly spaced along the edge 20 of the blade guard 14. The handle 24 includes a plurality of curved finger receiving contours 26, positioned on an opposite side 28 of the razor comb hair tool 10 relative to the spaced apart comb teeth 18 and the cutting edge 22 of the razor blade 12. That is, the handle 24 and the spaced apart comb teeth 18 may be positioned on opposite sides 28 and 30 of a longitudinal axis A through the razor comb hair tool 10.

Figure 2:
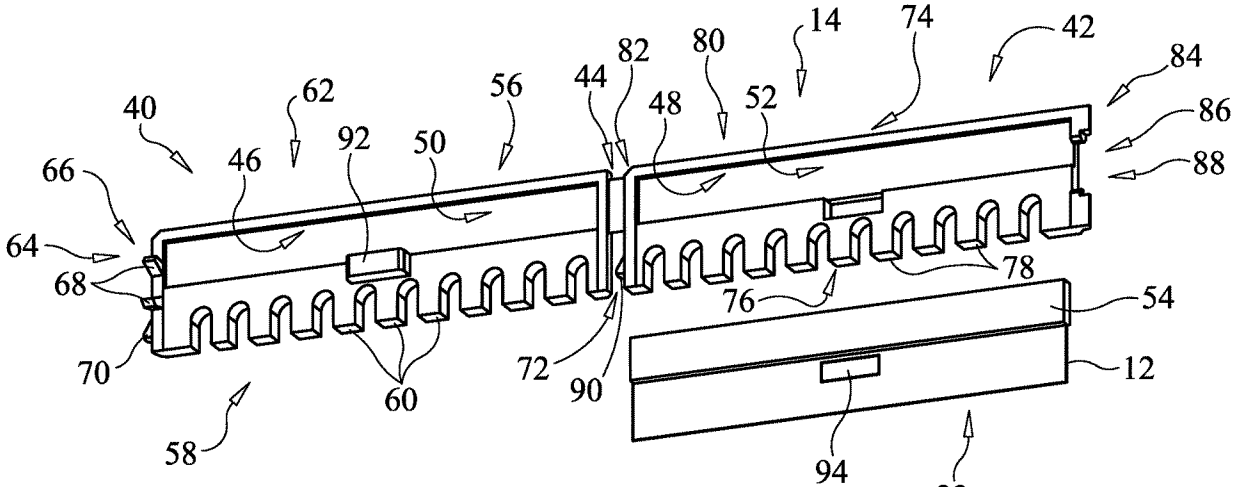
FIG. 2 is a perspective view of a blade guard, shown in an open position, and a razor blade, both exemplary components of the razor comb hair tool of FIG. 1.

Turning now to FIG. 2, the blade guard 14 of the razor comb hair tool 10 is shown in an open position, with the razor blade 12, which may or may not be a standard straight razor blade, removed from the blade guard 14. The exemplary blade guard 14 includes a first half 40 and a second half 42 joined by, and foldable relative to, a living hinge 44. Thus, the blade guard 14 may be made from a material, such as a polymer, consistent with the formation of the living hinge 44. Each half 40, 42 may include an inner surface 46, 48, respectively, defining a recess, or cavity, 50, 52 for receiving a flange, or handle, 54 of the razor blade 12. Thus, in the open position of the blade guard 14, the razor blade 12 may be positioned relative to one of the first and second halves 40 and 42 of the blade guard 14 such that the flange 54 is received by the respective recess 50 or 52. After the razor blade 12 is so positioned, the first and second halves 40 and 42 may be brought together, by folding one or both of the halves 40 and 42 together about the living hinge 44.

The halves 40 and 42 of the blade guard 14 may be complementary to one another, and may fold together to form a generally rectangular shape. The first half 40 may include the inner surface 46, which includes the recess 50 for receiving portions of the flange 54 of the razor blade 12, and an outer surface 56. The first half 40 also includes a first edge 58, defining first halves 60 of the plurality of spaced apart teeth 18 (shown in FIG. 1), and a second edge 62, which may be received by the retainer 16. A first side 64 of the first half 40 may include a fastening feature 66, which, when mated with a corresponding feature of the second half 42, maintains a closed position of the blade guard 14. According to the exemplary embodiment, the fastening feature 66 may include a pair of flexible protrusions 68 projecting from the inner surface 44. The first side 64 may also include a ramped protrusion 70 extending from the first side 64 and used to secure the blade guard 14 relative to the retainer 16. A second side 72 of the first half 40 may include, attach to, or define, portions of the living hinge 44.

The second half 42 may also include the inner surface 48, which includes the recess 52 for receiving the flange 54 of the razor blade 12, and an outer surface 74. As should be appreciated, only one of the first and second halves 40 and 42 may have features for retaining the razor blade 12 and/or may include alternative means for retaining the razor blade 12. The second half 42 also includes a first edge 76, defining second halves 78 of the plurality of spaced apart teeth 18 (shown in FIG. 1), and a second edge 80, which may be received by the retainer 16. The first and second halves 60 and 78 of the plurality of spaced apart teeth 18 have similar, or nearly identical, profiles such that in the closed position of the blade guard 14 corresponding teeth of the first and second halves 60 and 78 are aligned. A first side 82 of the second half 42 includes, attaches to, or defines, portions of the living hinge 44. A second side 84 of the second half 42 includes a fastening feature 86, such as an opening 88 shaped and sized to receive and retain the flexible protrusions 68 of the first half 40. The first side 82 may also include a ramped protrusion 90, similar to the ramped protrusion 70 of the first half 40, extending from the first side 82 and used to secure the blade guard 14 relative to the retainer 16.

According to some embodiments, and as shown, the inner surface 46 of the first half 40 may include a post 92 configured for receipt within or through a receiver 94 of the razor blade 12. The post 92 and receiver 94 may be incorporated into the design of the razor comb hair tool 10 in order to ensure proper positioning of the razor blade 12 relative to the blade guard 14. According to such an embodiment, non-standard razor blades, including the receiver 94, may be required for use with the razor comb hair tool 10.

Figure 3:
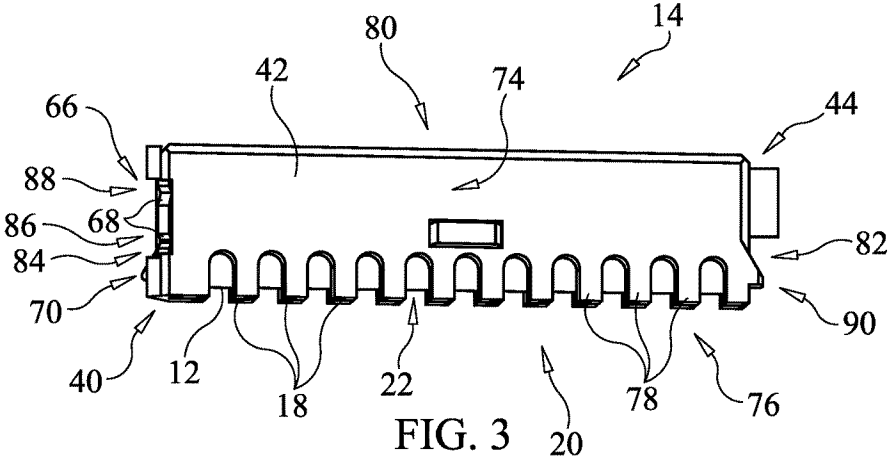
FIG. 3 is a perspective view of the blade guard of FIG. 2, shown in a closed position, with the razor blade retained within the blade guard.

Once the razor blade 12 is positioned relative to, or within, the blade guard 14, the first and second halves 40 and 42 may be folded together about the living hinge 44, and the fastening features 66 and 86 may be engaged to maintain a closed position of the blade guard 14, as shown in FIG. 3. In the closed position, the razor blade 12 is retained, or trapped, within the blade guard 14 and the cutting edge 22 of the razor blade 12 is aligned with and extends between the spaced apart comb teeth 18. The halves 40 and 42 of the blade guard 14 may be sized and shaped to provide a tight fit relative to the razor blade 12 to improve performance of the razor comb hair tool 10. To return the blade guard 14 to the open position of FIG. 2, the flexible protrusions 68 may be moved toward one another such that the protrusions 68 may pass back through the opening 88.

Figure 4:
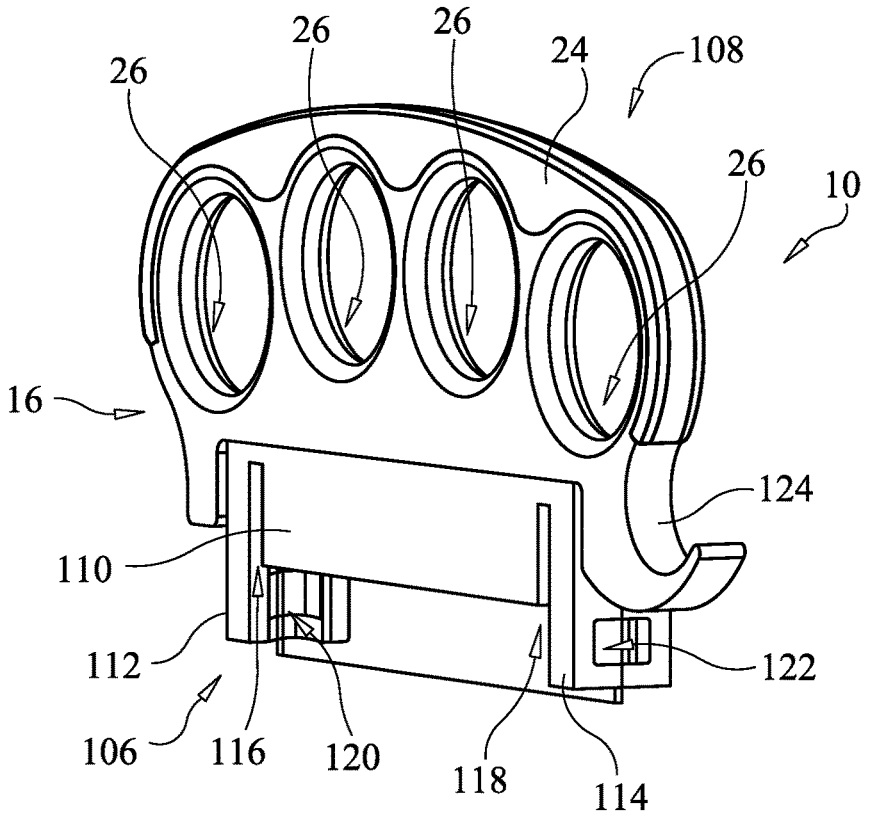
FIG. 4 is a perspective view of the blade guard, shown in the closed position of FIG. 3, prior to the blade guard being releasably received by a retainer of the razor comb hair tool.
Figure 4:
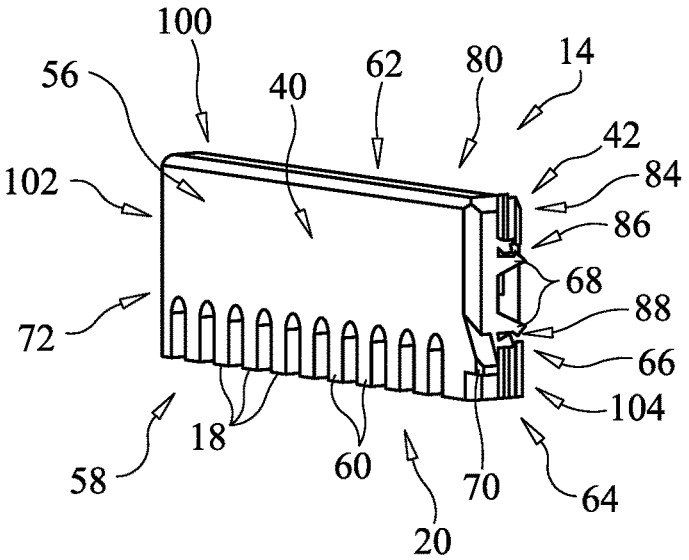

Turning now to FIG. 4, the blade guard 14 is shown in the closed position, prior to the blade guard 14 being releasably received by the retainer 16 of the razor comb hair tool 10 to define the assembled configuration of FIG. 1. In the closed position, the blade guard 14 has the first edge 20 defining the plurality of spaced apart comb teeth 18 and a second edge 100, defined by edges 62 and 80, that may be received by the retainer 16. Opposing sides 102 and 104 of the closed blade guard 14 include the ramped protrusions 70 and 90 introduced above, which may assist in securing the blade guard 14 relative to the retainer 16 and handle 24, as will be described below.

The retainer 16 has first and second opposing ends 106 and 108. The first end 106 of the retainer 16 releasably receives the second edge 100 of the blade guard 14. In particular, the first end 106 includes a housing 110 defined in part by a pair of flexible arms 112 and 114, with flexibility added by slots 116 and 118. As the second edge 100 of the blade guard 14 is inserted into the housing 110, the ramped protrusions 70 and 90 outwardly expand the flexible arms 112 and 114 until the protrusions 70 and 90 are received by respective openings 120 and 122 of the flexible arms 112 and 114. To remove the blade guard 14, the flexible arms 112 and 114 may be moved outward such that the protrusions 70 and 90 are removed from the openings 120 and 122 and the blade guard 14 may be pulled, or removed, from the retainer 16.

The second end 108 of the retainer 16, which may or may not be integral with the first end 106, couples or is integral with handle 24 of the razor comb hair tool 10 and includes the plurality of curved finger receiving contours 26. The curved finger receiving contours 26 may be closed finger openings, as shown, or may not be completely closed. The handle 24 is positioned opposite the comb teeth 18 and razor blade cutting edge 22, as mentioned above, and may include a hair separating feature 124, such as a curved protrusion, used to part hair. Various configurations for the handle 24 are contemplated. Although any number and/or shape of finger receiving openings or spaces, which are used to facilitate grasping, use, and manipulation of the razor comb hair tool 10, are contemplated with respect to the handle 24, only three additional examples are shown.

Figure 5:
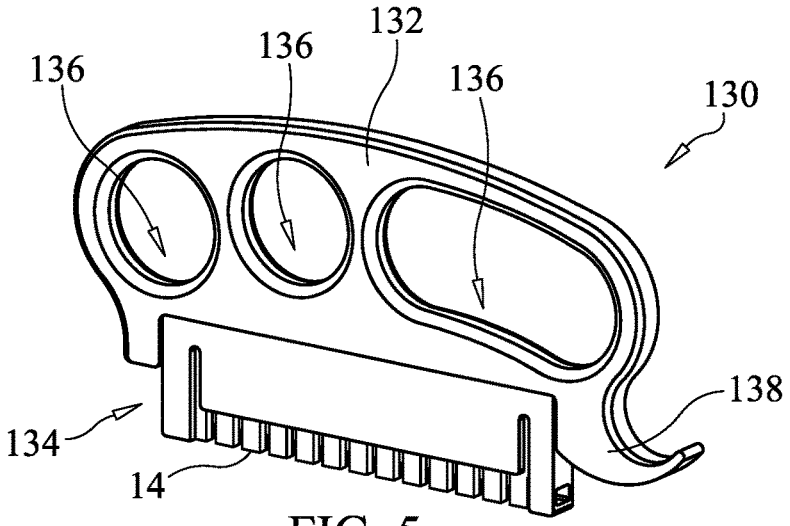
FIG. 5 is a perspective view of a second exemplary embodiment of a razor comb hair tool of the present disclosure, having a first alternative handle of the retainer.
Figure 6:
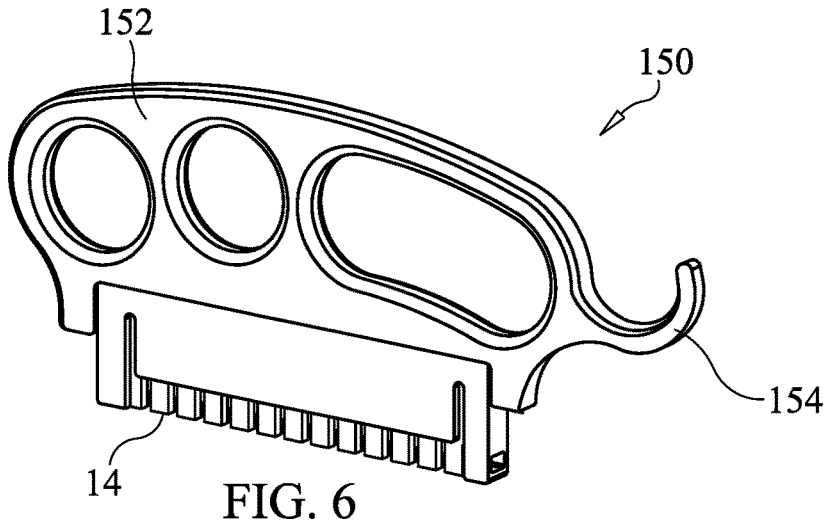
FIG. 6 is a perspective view of a third exemplary embodiment of a razor comb hair tool of the present disclosure, having a second alternative handle.
Figure 7:
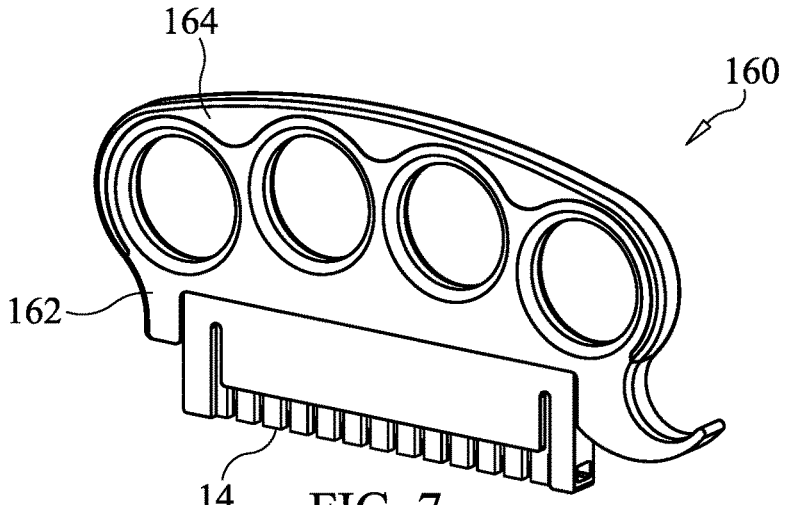
FIG. 7 is a perspective view of a fourth exemplary embodiment of a razor comb hair tool of the present disclosure, having a third alternative handle.

Turning now to FIG. 5, a retainer 130 having an alternative handle 132 is shown. A first end 134 of the retainer 130 is similar to the first end 106 of the retainer 16 discussed above and reveals the blade guard 14 described above releasably received by the retainer 130. The handle 132 may include three curved finger receiving contours 136 and a hair separating feature 138. The curved finger receiving contours 136 may be defined by portions of enclosed openings (as shown), although it is not necessary. As presented, the curved finger receiving contours 136 may or may not have similar shapes and sizes. Turning now to FIG. 6, a retainer 150 having another alternative handle 152 is shown. According to the embodiment of FIG. 6, a hair separating feature 154 may have an alternative positioning relative to the previous embodiments. As shown in FIG. 7, a retainer 160 having an alternative handle 162 may include a grip portion 164, made from a softer material than a remaining portion of the handle 162 to provide a comfortable, tactile, and precise grip. Any of the embodiments may incorporate ring inserts, as are known to those skilled in the art, for reducing the finger opening sizes and properly centering a user's fingers within the openings.

Figure 11:
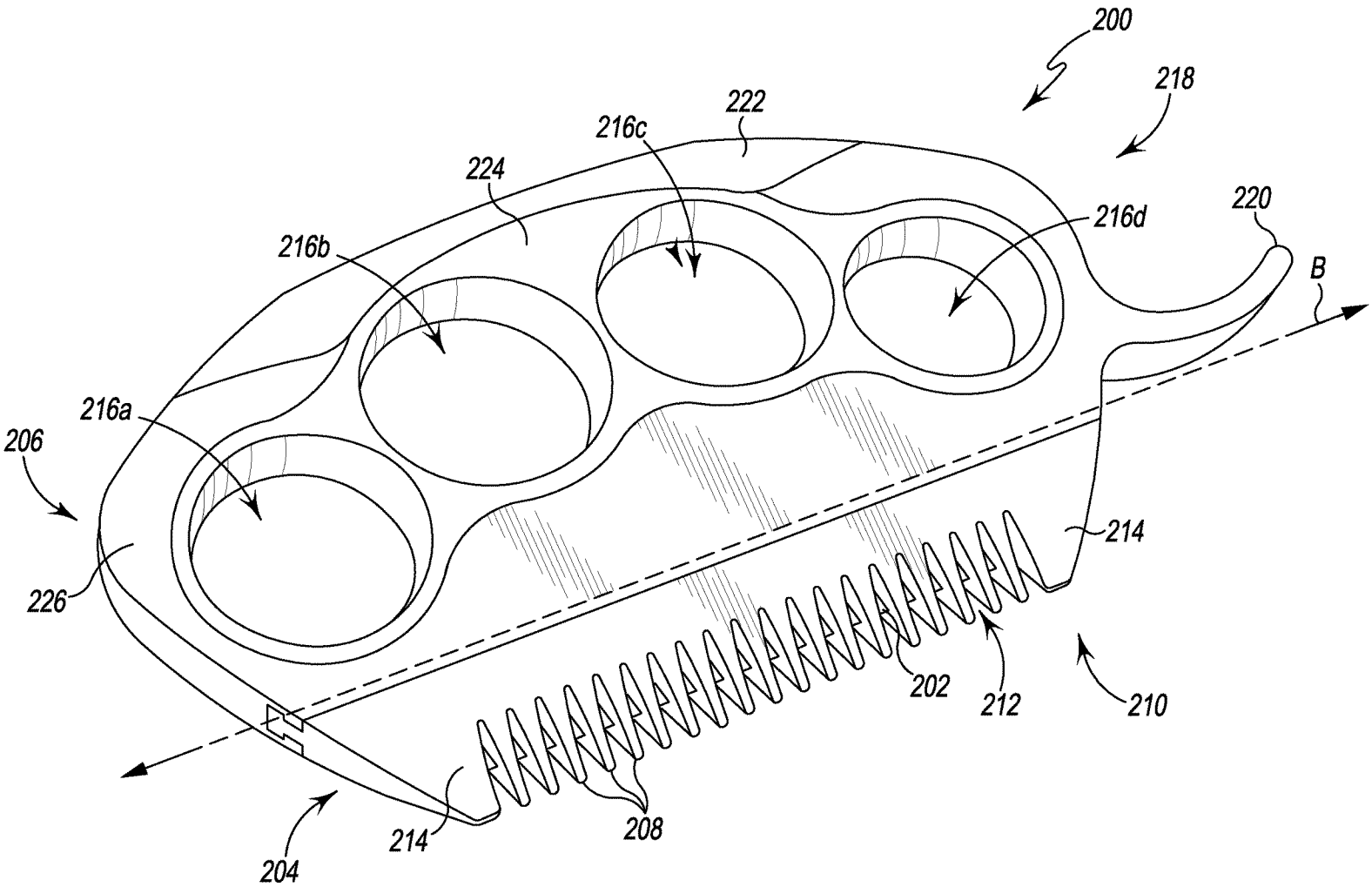
FIG. 11 is a perspective view of an eighth exemplary embodiment of a razor comb hair tool of the present disclosure, have an alternative handle and blade guard.
Figure 12:
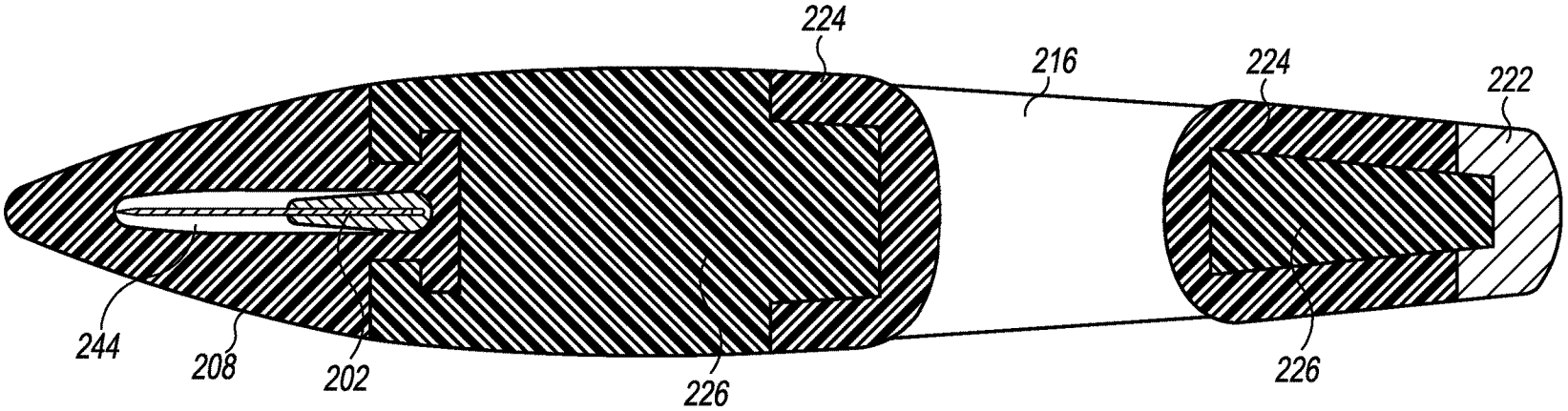
FIG. 12 is a cross-sectional view of the eighth exemplary embodiment of the razor comb hair tool of FIG. 11.

FIGS. 11 and 12 illustrate another exemplary hair tool 200, according to the present disclosure. The hair tool 200 includes a guard member (e.g. blade guard 204) and a handle member (e.g. handle 206) shown in an assembled configuration. The exemplary hair tool 200 is adapted to retain a razor blade 202 within the blade guard 204, although the hair tool 200 may be used without it. For the purposes of illustration herein, the exemplary hair tool 200 is substantially shown and described including the presence of a razor blade 202.

Although specific configurations are shown and described for each of the blade guard 204, handle 206, and razor blade 202, it should be appreciated that configurations of these components, including sizes, shapes, and features, may vary without deviating from the scope of the present disclosure. For example, the blade guard 204, handle 206, or razor blade 202 may be made from any known materials, selected for ease of manufacture and/or to enhance performance of the hair tool 200. Additionally, the razor blade 202 may be a standard sized razor blade or custom sized, depending on the contemplated use for the hair tool 200.

As will be described in greater detail below, the exemplary assembled configuration of the hair tool 200 may include a razor blade 202 retained within an elongated blade guard 204, and the blade guard 204 may be slidably received by the handle 206. The assembled configuration may expose a plurality of spaced apart comb teeth 208 located between opposing end sections 214 of the blade guard 204 and defined by a first edge 210 of the blade guard 204. A cutting edge 212 of the razor blade 202 may align with and extend between adjacent ones of the spaced apart comb teeth 208. As shown, the cutting edge 212 may be receded relative to free tips or distal ends of the spaced apart comb teeth 208, but extend within and span the open cavity 244 (shown in FIG. 12) defined between the base and the distal ends of the spaced apart comb teeth. In addition, the spaced apart comb teeth 208 may be evenly spaced along the edge 210 of the blade guard 204.

The handle 206 may be positioned on an opposite side 218 of the razor comb hair tool 200 relative to the spaced apart comb teeth 208 and the cutting edge 212 of the razor blade 202. That is, the handle 206 and the spaced apart comb teeth 208 may be positioned on opposite sides 218 and 210 of a longitudinal axis B through the razor comb hair tool 200. The handle 206 may be composed of a main body portion 226, a contour portion 224, and a handle insert 222, although other contemplated embodiments may only include the main body portion 226 or, optionally, may include any other described components in varying combinations.

Each of the main body 226, the contour portion 224, and the handle insert 222 may vary in size and shape or be composed of any known material (e.g. polypropylene). Further, the main body 226 and/or contour portion 224 may include an inner core of stronger material, such as a metal or alloy (e.g. steel, zinc, or aluminum) or a plastic (e.g. polybutylene, polyethylene terephthalate, or polypropylene), a portion of which, for example contour portion 224, may be overmolded or coated by a softer material (e.g. an elastomer such as a thermoplastic vulcanizate, such as santoprene). The shapes of the main body 226 and the blade guard 204 may vary as well. The exemplary hair tool 200 illustrates an embodiment with the main body 224 sized for accepting four fingers of the average-sized hand in combination with a narrower width for the blade guard 204, which accepts an average-sized razor blade 202.

The main body 226 of the handle 206 may include a hair separating feature 220, such as a curved protrusion, used to part hair. Although only one embodiment is shown, various designs for the hair separating feature 220 are contemplated, such as differing locations, shapes, or sizes. The illustrated hair separating feature embodiment deviates from most typical hair separating features in that it is curved, which provides for both safety and utility. The short, curved design allows a user to avoid causing accidental injury from poking a subject. It also allows the user to manage hair more easily, providing a user the ability to pick up hair and move it to the side, if necessary.

Additionally, the main body 226 of the handle 206 may include a handle insert 222. The handle insert 222 may be included to add weight or balance to the hair tool 200, for aesthetics, or to lower the cost and complexity of manufacturing of the hair tool 200 by minimizing wall thickness of the main body 226 and improving moldability. The handle insert may be manufactured out of any known materials selected for ease of manufacture and/or to enhance performance, for example, plastic or metal, such as brass or aluminum. The overall shape and size of the handle 206 would remain the same despite whether the handle insert 222 is included, therefore the main body 226 would be sized accordingly.

The contour portion 224 of the handle 206 may contain a plurality of curved finger receiving contours 216(*a-d*), adapted to receive one or more of the index, middle, ring, or baby fingers. Although four fingering receiving contours 216 are shown, various embodiments are contemplated wherein less than four finger receiving contours 216 may be employed, and/or the sizes or shapes of the finger receiving contours 216 are varied. The finger receiving contours 216 may or may not be laterally centered on the handle 206.

While finger receiving contours 216 of known hair tools are oriented in a straight line across the main body of the handle, or curved wherein the middle and ring fingers are positioned closer to the blade guard (or comb end) than the index and baby fingers, the finger receiving contours 216 of the exemplary hair tool 200 are curved wherein the middle and ring fingers are positioned farther away from the blade guard 204 than the index and baby fingers. This variation of the curved finger receiving contours allows for the alignment of the four fingers when the user's hand is partially closed around the handle 206. Further, the relative sizes of the finger receiving contours 216(*a-d*) can be varied. For one example, as illustrated in the exemplary hair tool 200, the middle finger contour 216*b* can be fitted with a larger-sized opening, the index and ring finger contours 216*a*, 216*c* can be fitted with a medium-sized opening, and the baby finger contour 216*d* can be fitted with a small-sized opening. These features accommodate the natural grip of a user's hand, advantageously providing greater comfort and precision than other known hair tools provide. Still further, the finger receiving contours 216 may be sized such that they can receive a user's hand at positions up to the first, second, or third knuckles, depending on the particular size, fit, and preference of the user.

Figure 13:
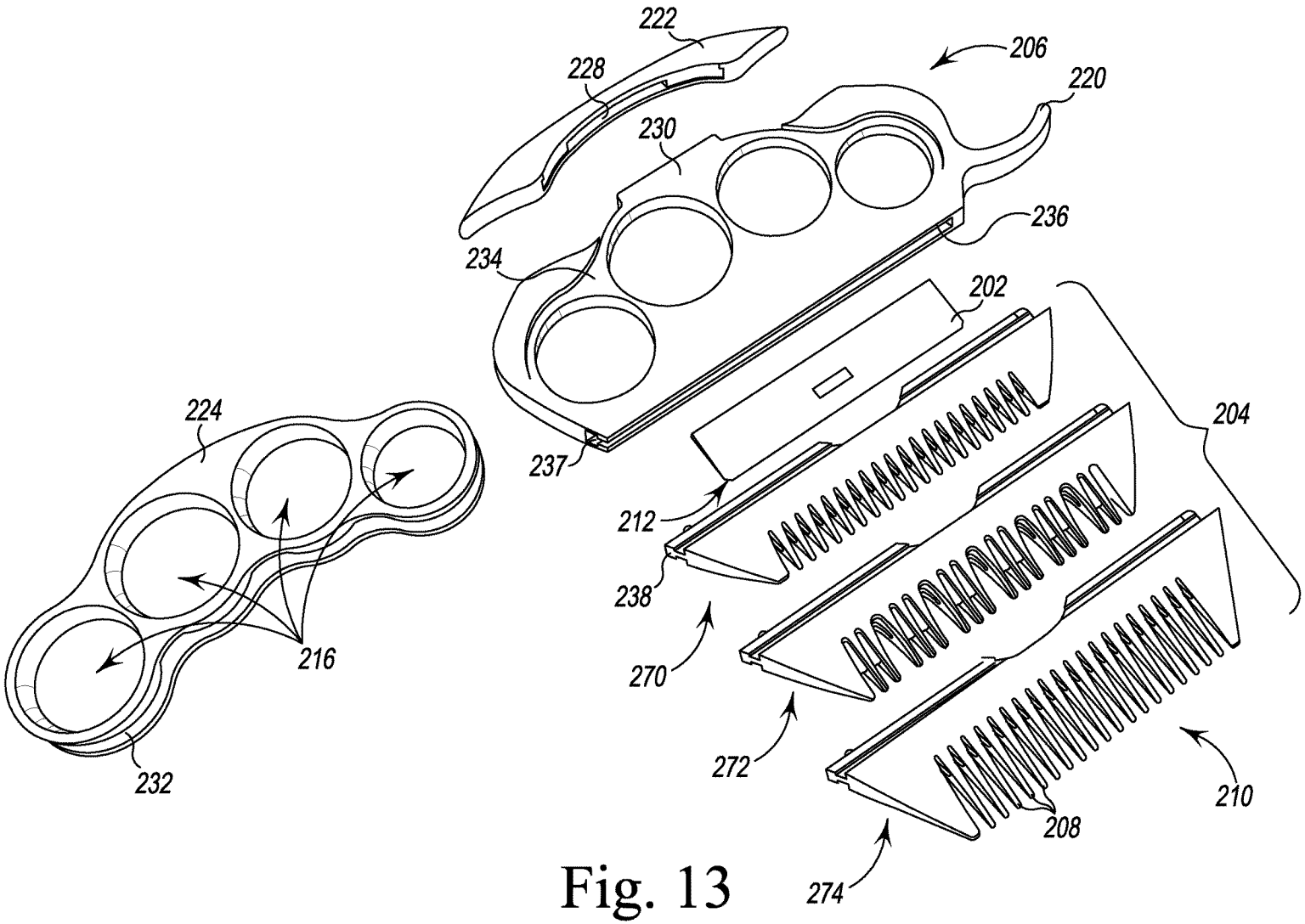
FIG. 13 is an exploded view of the eighth exemplary embodiment of the razor comb hair tool of FIG. 11 showing alternative embodiments of blade guards.

Turning to FIG. 13, the exemplary hair tool 200 is illustrated in its individual, unassembled components and illustrates optional and/or alternative components. The handle 206 is illustrated separated into three components: the main body 226, the contour portion 224, and the handle insert 222. The contour portion 224 may be molded into the main body 226, for example, by utilizing a flange 232 on the contour portion 224 to be fit into a recess 234 on the main body 226. For example, the flange 232 may be an overmolded elastomer. Alternatively, the contour portion 224 and main body 226 may be manufactured as a single component. If desired, a handle insert 222 may be manufactured with a slot 228 to be received by a tab 230 on the main body 226 as shown. However, if a handle insert 222 is not included, neither the slot 228 nor the tab 230 would be required.

Further, FIG. 13 illustrates three different embodiments, 270, 272, and 274, of the blade guard 204. The comb teeth 208 of the blade guard 204 may be evenly spaced along the edge 210 of the blade guard 204, or may be designed in varying configurations as illustrated in FIG. 13 to allow more or less hair through the comb teeth 208. If the razor blade has been inserted into the cavity 244 within the blade guard 204, different interchangeable embodiments of the blade guard 204 can be employed to allow varying amounts or lengths of hair to come into contact with the cutting edge 212 of the razor blade 202.

Alternative blade guards 270 and 274 provide equal spacing between the comb teeth 208; however they extend to varying distances from the cutting edge 212 of the blade 202 and therefore cut hair to differing lengths. Alternatively, blade guard 272 illustrates a different comb style relative to blade guards 270 and 274 as it utilizes fewer comb teeth 208 and therefore greater spaces between the comb teeth. This variation exposes the cutting edge 212 of the blade 202 to more hair than the blade guards 270 and 274. Although three embodiments of the comb teeth 208 of the blade guard 204 are shown, additional comb teeth embodiments are known and used in the art and may be adapted for use on the edge 210 of the blade guard 204 for the exemplary hair tool 200. For example, numerous variations of comb teeth may be employed, depending on the intended use with different hair styles, thickness, or length, or based upon the effect of a particular comb upon the hair.

Figure 14:
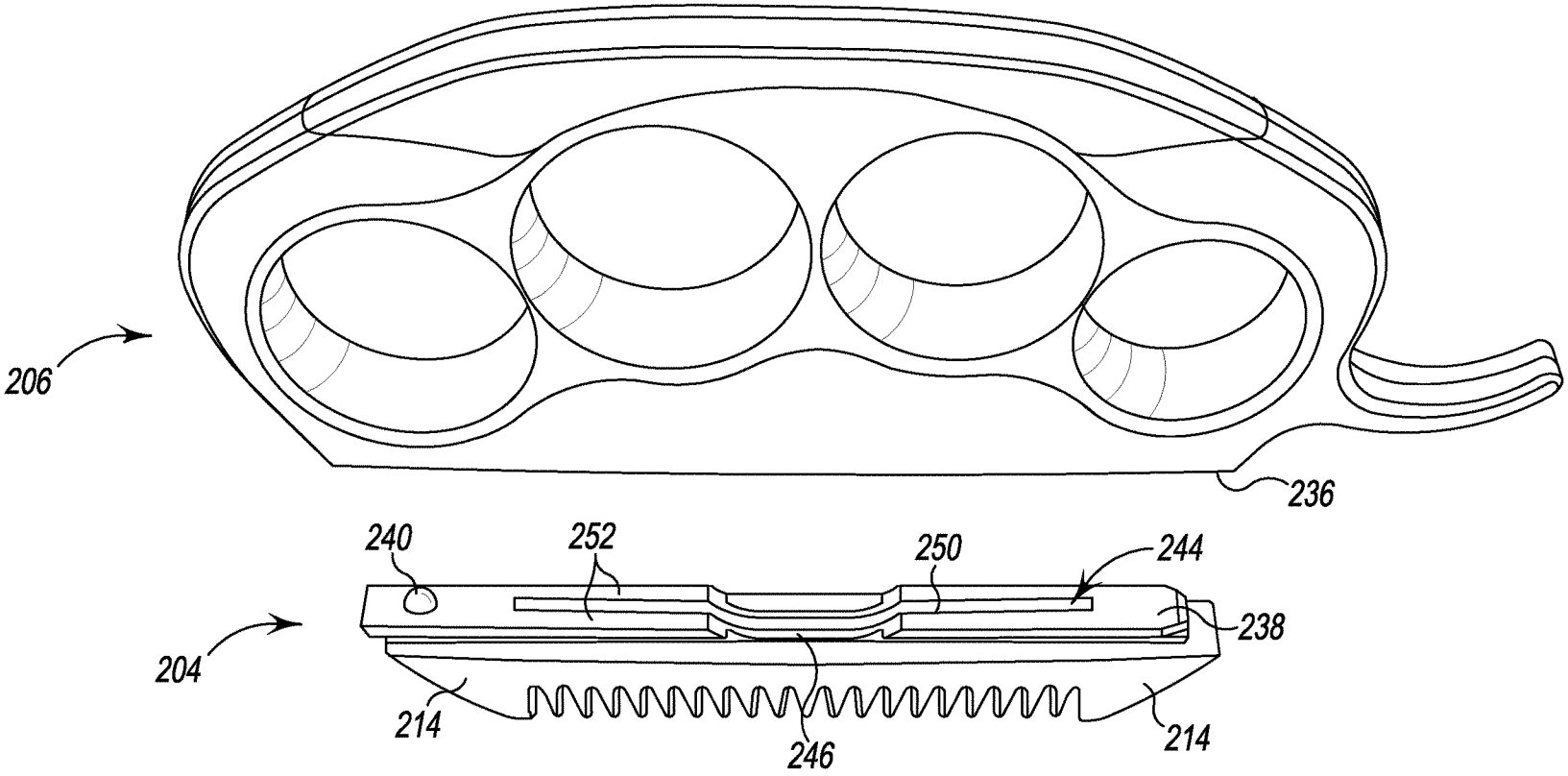
FIG. 14 is an upper perspective view of the eighth exemplary embodiment of the razor comb hair tool of FIG. 11 showing the handle and blade guard disassembled.
Figure 15:
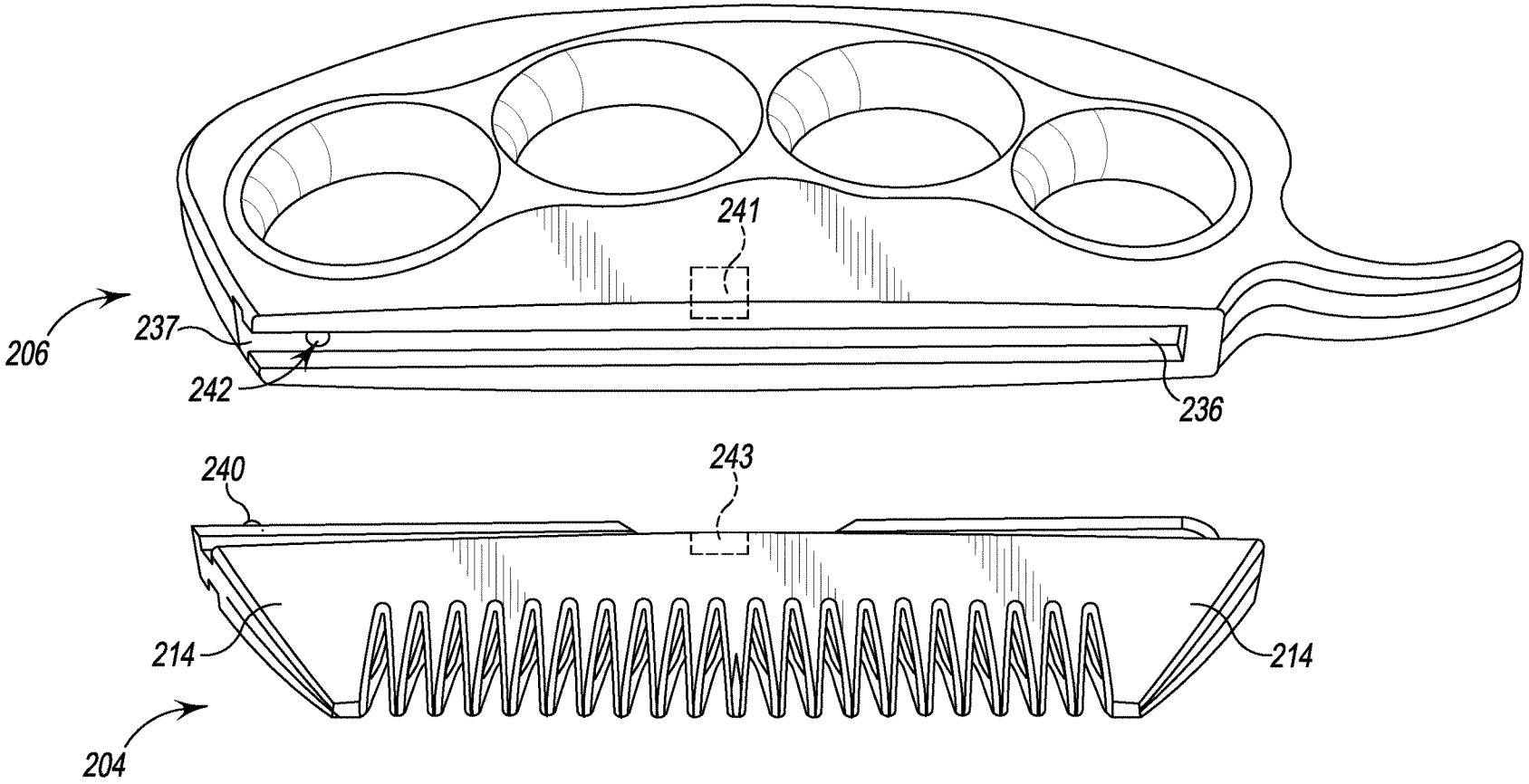
FIG. 15 is a lower perspective view of the eighth exemplary embodiment of the razor comb hair tool of FIG. 11 showing the handle and blade guard disassembled.

In FIGS. 14-15, the blade guard 204 and handle 206 of the exemplary hair tool 200 are illustrated as disconnected. The blade guard 204 may include a sliding edge, or tenon, 238 and the handle may include a receiving edge, or socket, 236, wherein the tenon 238 is adapted to slidably connect to the socket 236. The socket 236 may have a narrower recess connected to a wider base, and the tenon 238 may have a narrower neck and a wider head matching the mating recess of the socket 236. Optionally, the socket 236 and tenon 238 may be designed such that the socket 236 is located on the blade guard 204 and the tenon 238 is located on the handle, or the structure may be varied in any other fashion as to allow a functional sliding connection between the blade guard 204 and the handle 206. In the illustrated embodiment, the sliding connection may only be initiated from one end of the handle 206, via inlet 237, however alternative embodiments may accept sliding connections from the opposite end or from both ends.

While the blade guard 204 and handle 206 are disconnected, a user may insert a razor blade 202 into a cavity 244 within the blade guard 204 via an opening 250 on the sliding edge 238. The cavity 244 is defined by a centralized hollowed inner section within the blade guard, partially enclosed between opposing end sections 214, opposing side sections 252, and the tips of the spaced apart comb teeth 208, wherein a portion of the cavity 244 extends a distance into each of the plurality of comb teeth 208. Since the cavity 244 extends a distance into each of the plurality of comb teeth 208, the insertion of a razor blade 202 into the cavity 244 may allow the cutting edge 212 to extend into the open space defined between adjacent ones of the spaced apart comb teeth. This distance the cavity extends into the comb teeth 208 may be varied for different embodiments of blade guards 204, depending on the use contemplated for the hair tool 200. Once the blade guard 204 and the handle 206 are connected, the cavity 244, and optionally the razor blade 202, is fully enclosed with the sliding edge 238 covering the opening 250. Therefore, when the hair tool 200 is fully assembled by connecting the blade guard 204 and handle 206, the razor blade 202 is locked into place.

Upon disconnecting the blade guard 204 and handle 206, a user may remove the razor blade 202 from the cavity 244 via the opening 250 in the blade guard 204. To assist the user in removing the razor blade 202, the opening 250 may include an indentation 246 to expose an edge of the razor blade 202, preferably the edge designed to be used as a handle on the common razor blade. The cavity 244 and opening 250 may accommodate one or more of the varying common razor blades, such as flat steel razor blades or those having one thicker edge due to a folded layer.

To prevent the blade guard 204 from sliding relative to the handle 206 during use, the sliding edge 238 and receiving edge 236 may be equipped with a movement-restricting mechanism. Upon sliding the blade guard 204 onto the handle 206, protrusion 240 may be positioned into recess 242 to hold the firm slidable connection and resist unintentional sliding movement. Other movement-restricting mechanisms may be employed, including, but not limited to, a sliding lock button or a push-to-unlock button. For example, a sliding lock 241 (shown in FIG. 15) may be incorporated into the main body 226. Upon a user pressing the sliding lock 241 toward the blade guard 204, the sliding lock 241 may insert into a mating detent 243 on the blade guard 204 to secure the handle 206 and blade guard 204 from unintentional sliding.

Figure 16:
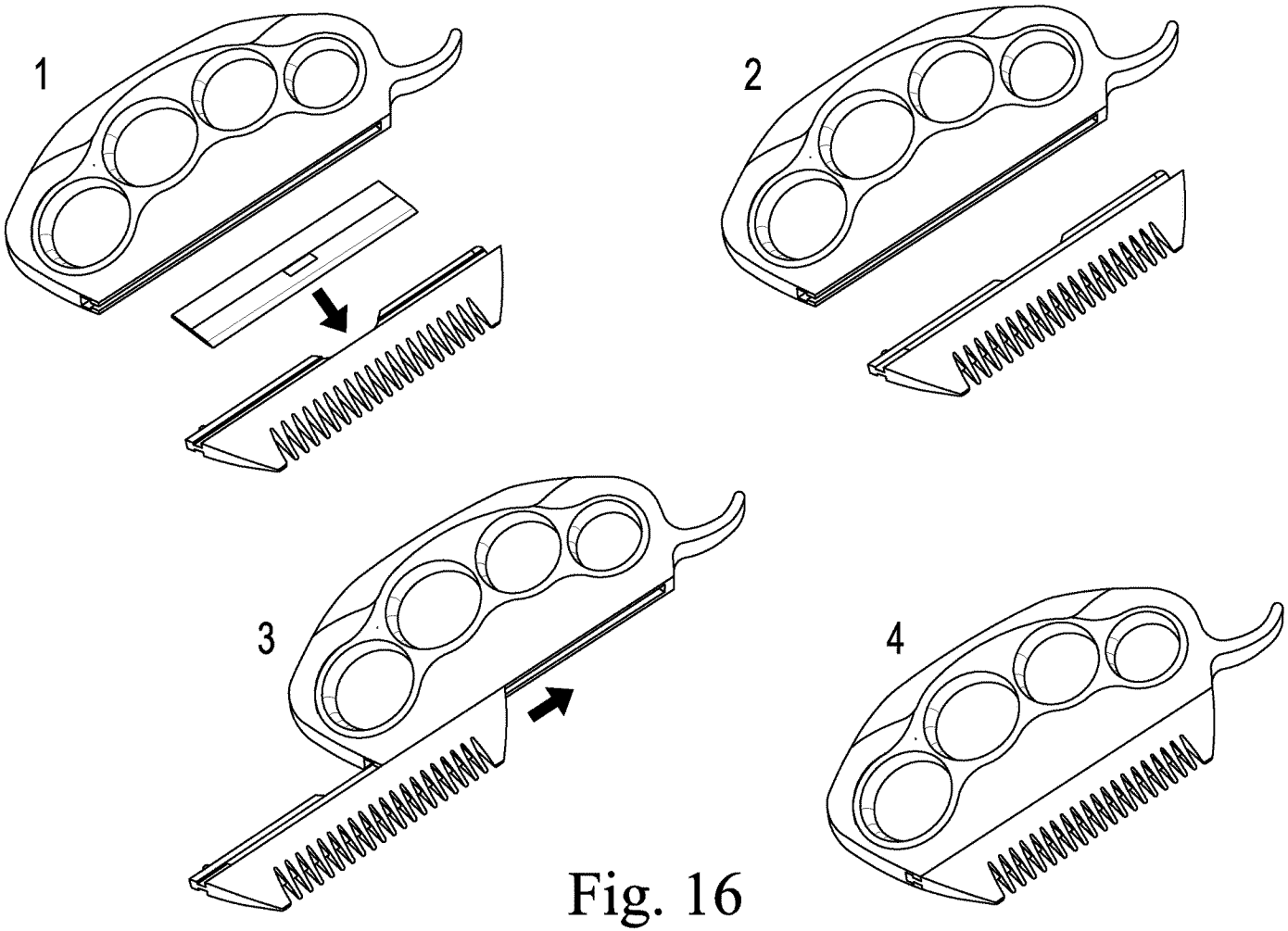
FIG. 16 is a perspective view of the eighth exemplary embodiment of the razor comb hair tool of FIG. 11 showing the steps for assembling it for use as a razor comb.

Turning to FIG. 16, the exemplary method of inserting a razor blade 202 and slidably connecting the blade guard 204 to the handle 206 is illustrated. At step one, the user may optionally insert a razor blade 202 through the opening 250 into the cavity 244 of the blade guard 204. At step two, the razor blade 202 is positioned inside the cavity 244, and the slidable connection is ready to be made. At step three, the sliding edge 238 of the blade guard 204 is connected to the receiving edge 236 of the handle 206 and the blade guard 204 is slid along the elongated axis B (shown in FIG. 11) until opposing end sections 214 align with the main body 226 of the handle 206. Optionally, a movement-restricting mechanism may engage after this alignment to prevent unintentional sliding. Finally, at step four, the exemplary hair tool 200 is assembled and prepared for use.

Figure 17:
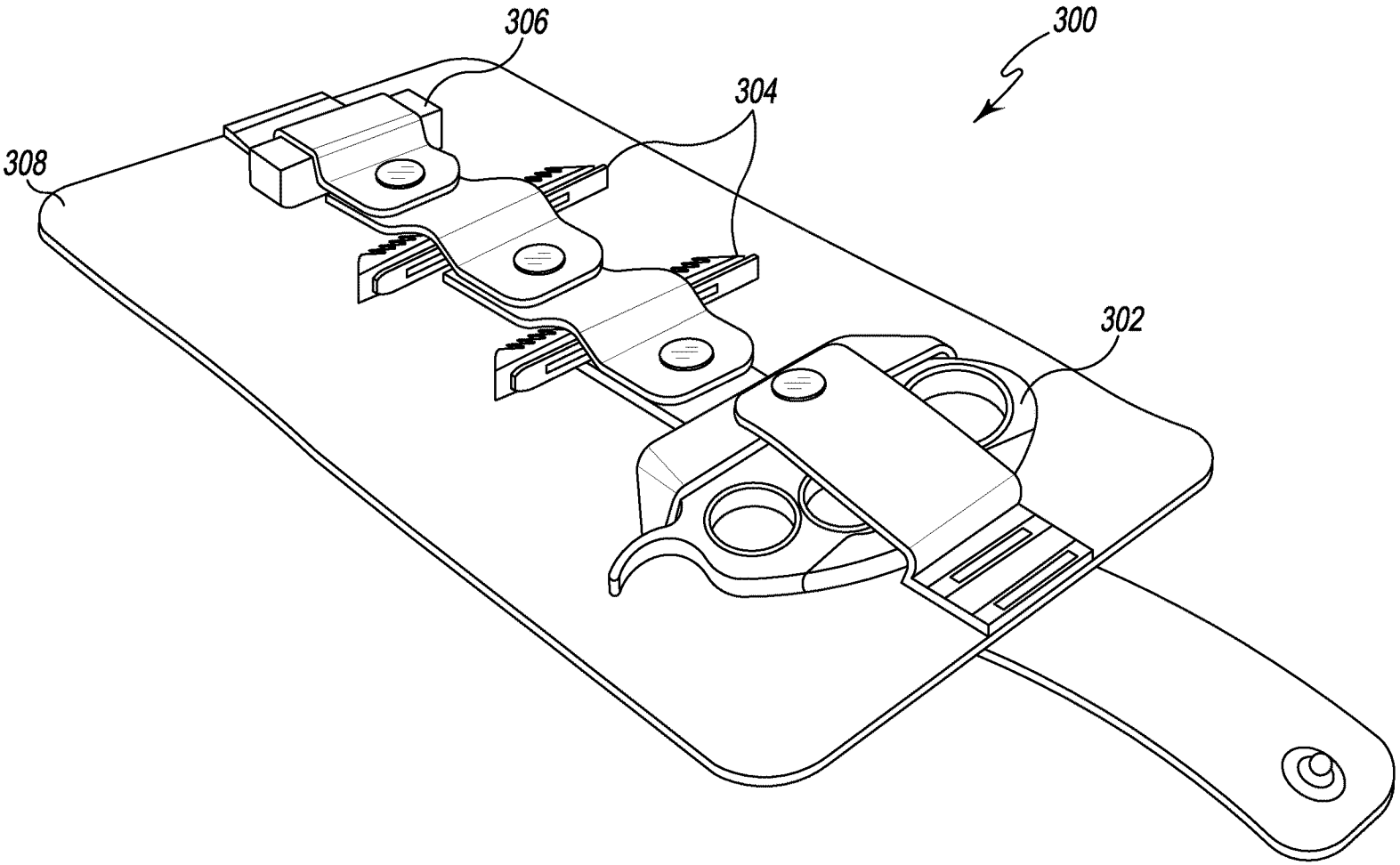
FIG. 17 is a perspective view of an exemplary embodiment of a razor comb hair tool kit of the present disclosure.
Figure 18:
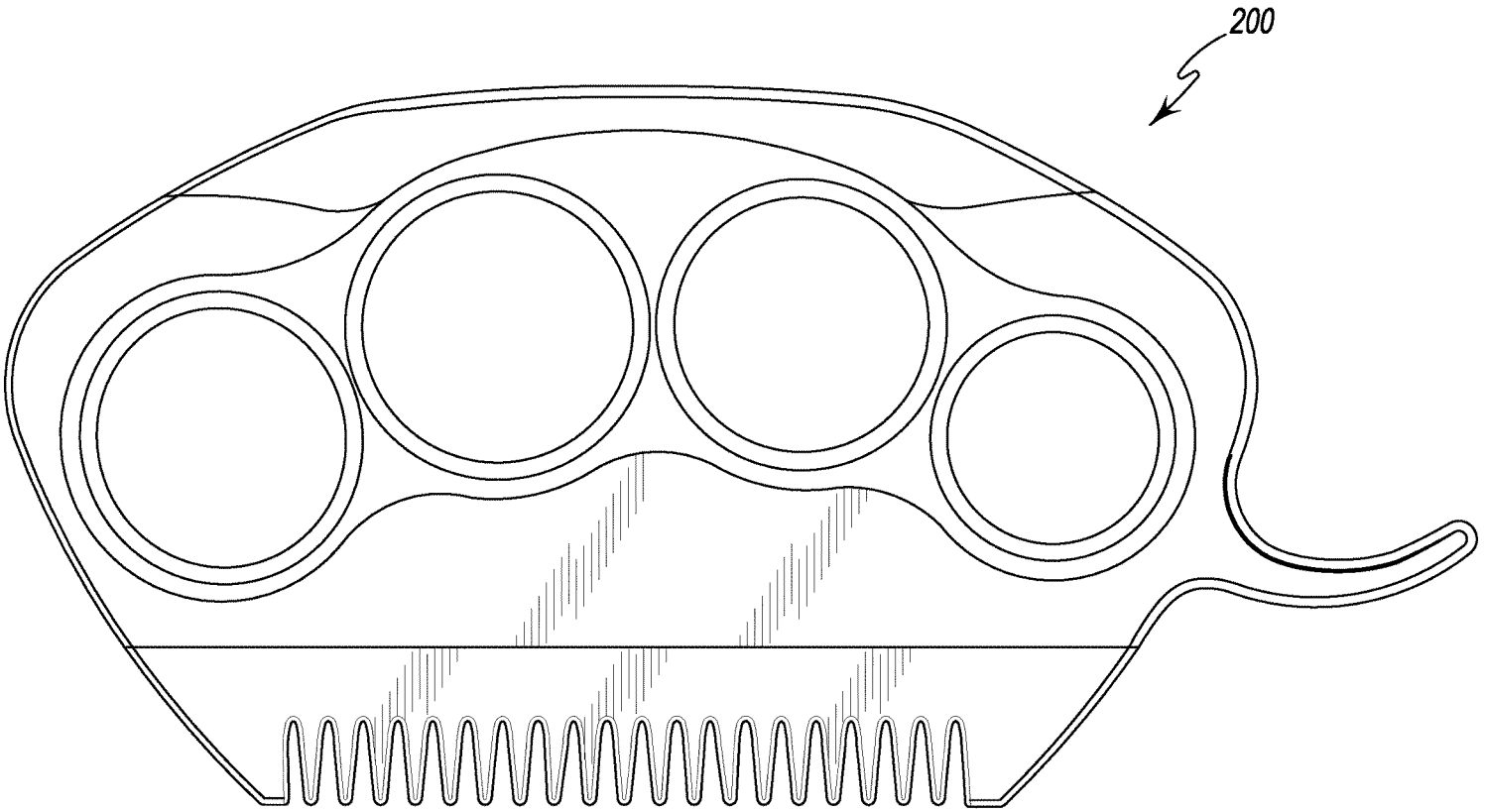
FIG. 18 is a first side view of the eighth exemplary embodiment of the razor comb hair tool of FIG. 11.
Figure 19:
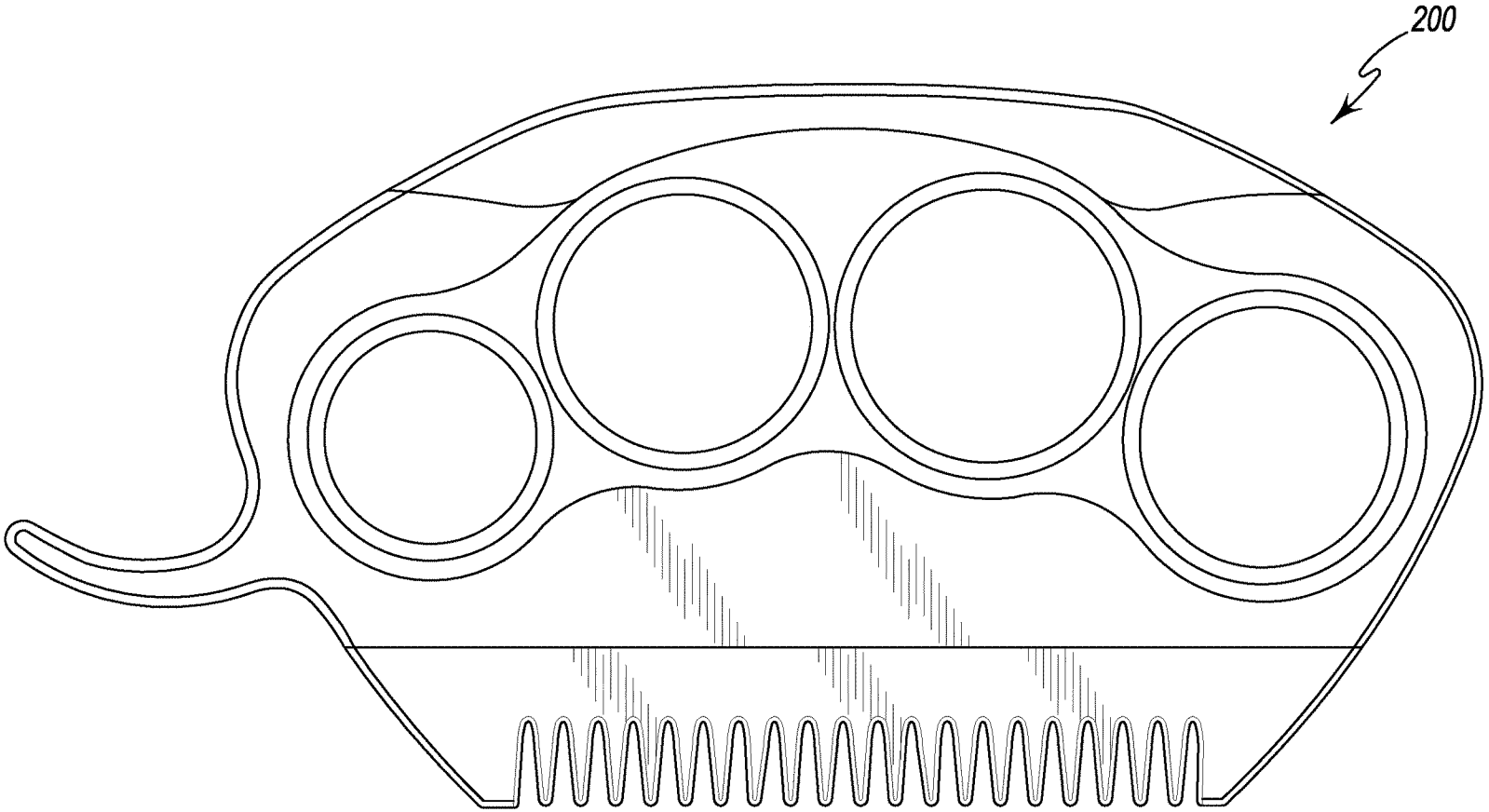
FIG. 19 is a second side view of the eighth exemplary embodiment of the razor comb hair tool of FIG. 11.
Figure 20:
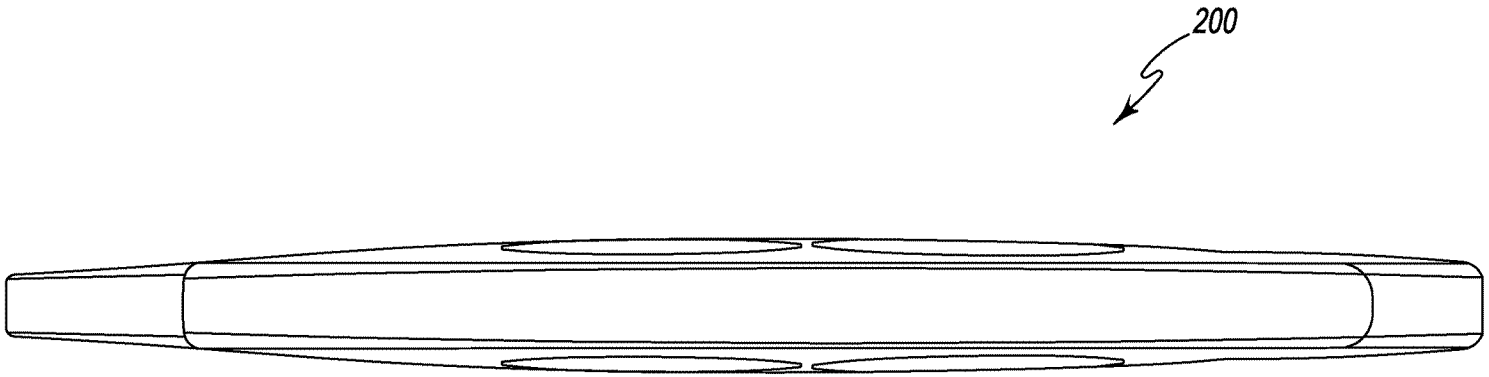
FIG. 20 is a top view of the eighth exemplary embodiment of the razor comb hair tool of FIG. 11.
Figure 21:
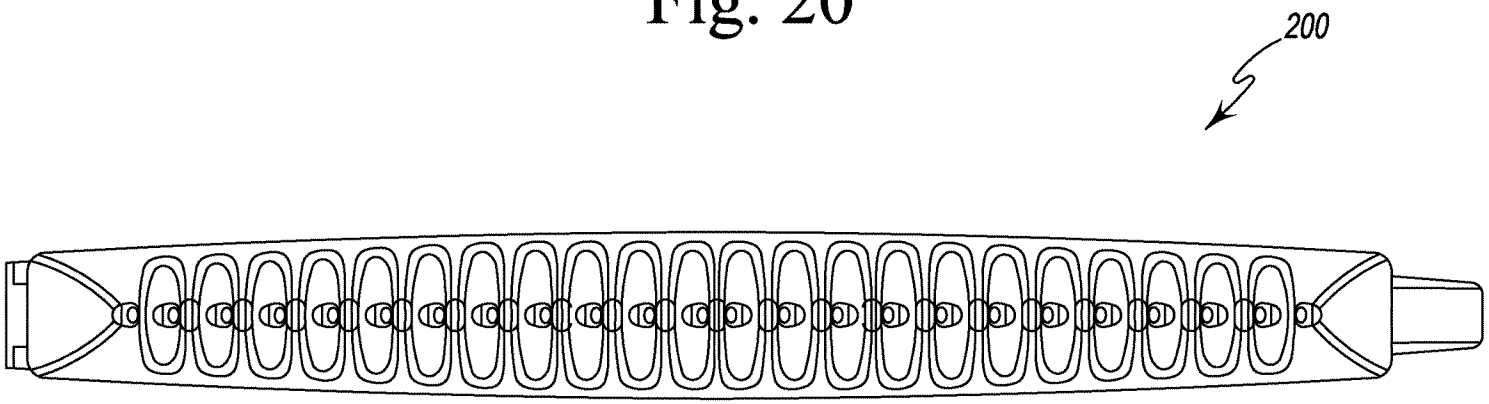
FIG. 21 is a bottom view of the eighth exemplary embodiment of the razor comb hair tool of FIG. 11.
Figure 22:
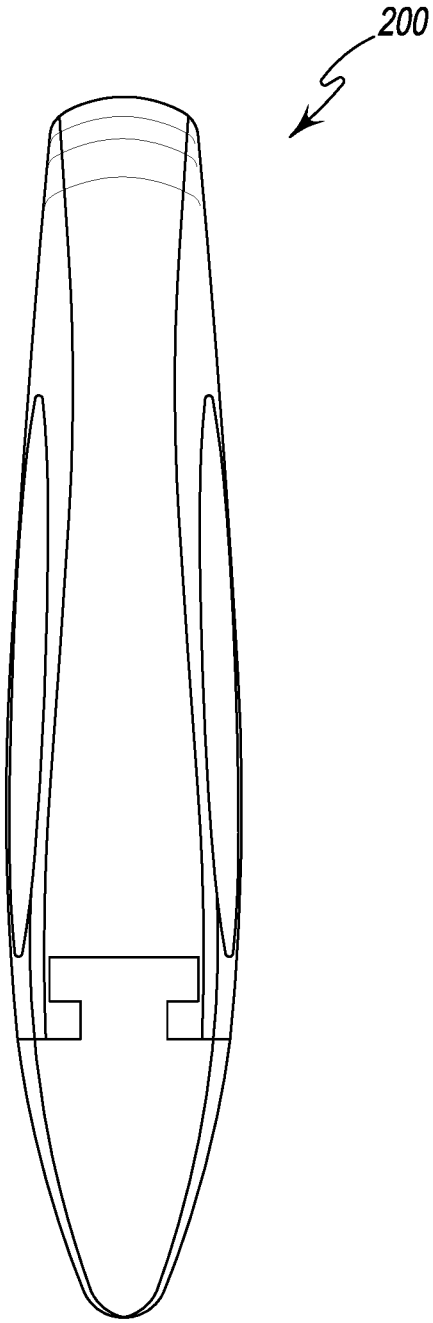
FIG. 22 is a first end view of the eighth exemplary embodiment of the razor comb hair tool of FIG. 11.
Figure 23:
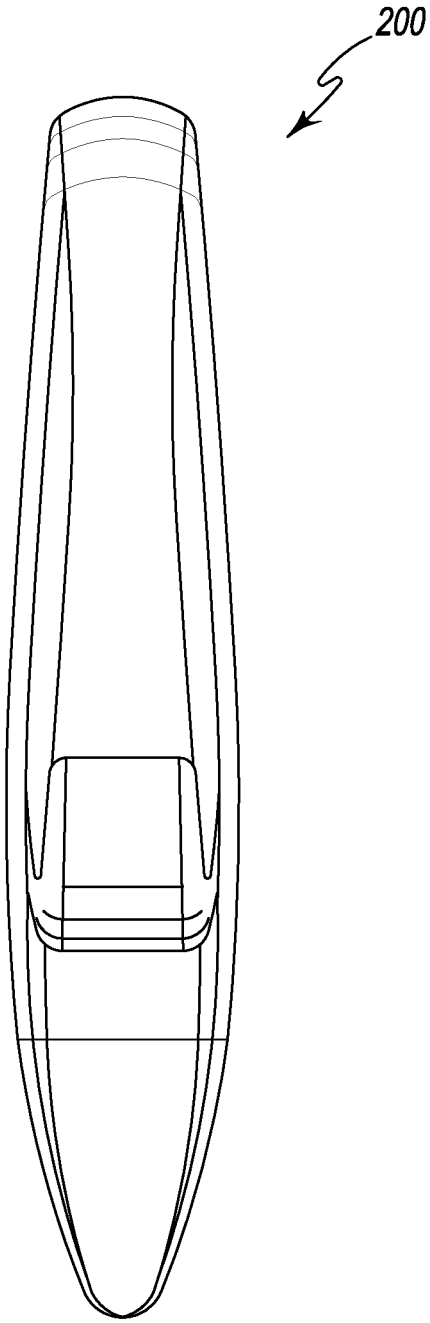
FIG. 23 is a second end view of the eighth exemplary embodiment of the razor comb hair tool of FIG. 11.

Turning to FIG. 17, the exemplary hair tool 200 of the present disclosure may be provided as a kit 300, including one or more handles 302, such as handles 24, 132, 152, 162 or 206, one or more blade guards, such as blade guards 14, 170,180, 190, 204, 270, 272, or 274, and one or more disposable razor blades, such as razor blade 12 or 202. For example, as illustrated, the kit 300 may include spare razor blades 306, a set of alternative blade guards 304, and a handle 302 (optionally including an assembled handle and blade guard). Alternative kits may also include alternative handles, blade guards 304, and/or replacement razor blades. Further, various styles of storage cases 308 may be employed, for example, those differing in shape, size, and/or material.

The razor blade 202 may be more quickly, easily, and safely inserted into and removed from the exemplary hair tools than in conventional hair tools utilized as razor combs. That is, the blade guards (e.g. blade guards 14, 170, 180, 190, 204, 270, 272, or 274) of the exemplary hair tools may close around the razor blade 202 to secure the razor blade 202 in such a way to shield a user from direct contact with it. Further, safe removal of the razor blade 202 is provided by the indentation 246 wherein a user may grasp a non-sharp edge of the razor blade 202. Replacement of the razor blade as well as cleaning the blade guards are both improved by this configuration, contributing to an improved ability to sanitize, sterilize, and reuse the hair tool. The materials composing all of the parts of the exemplary hair tools are provided such that they are able to withstand repeated exposure to commonly used sterilization techniques and/or chemicals, with or without disassembly.

The shape, size, spacing between, and configuration of comb teeth 18, 172, 182, 192, and 208 may be selected to provide desired exposure of the cutting edge 22, 212 of the razor blade 12, 202 and, thus, desired performance of the hair tool 10, 200. For example, the spacing, size, and shape of teeth 192 of FIG. 10 may provide thinning and blending, while the spacing, size, and teeth 182 of FIG. 9 may provide choppy, edgy, or blunt texture. The curved teeth 172 of FIG. 8 may create a softer looking texture. The design of the razor comb hair tool 10 disclosed herein permits ambidextrous use, is more ergonomic than conventional designs, and may be readily differentiated from standard combs.

Figure 8:
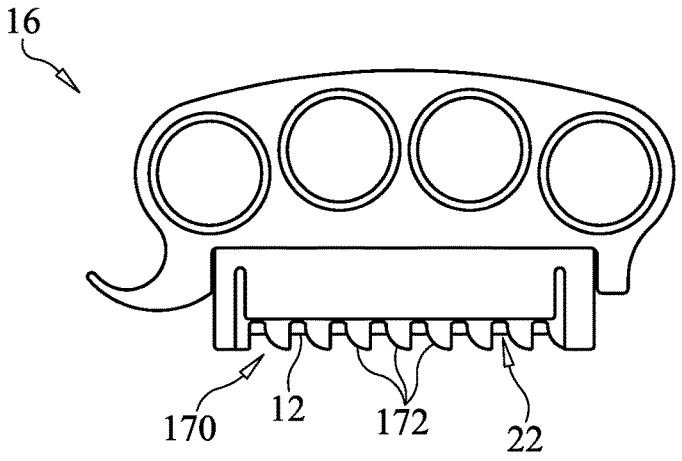
FIG. 8 is a side view of a fifth exemplary embodiment of a razor comb hair tool of the present disclosure, having a first alternative set of comb teeth.
Figure 9:
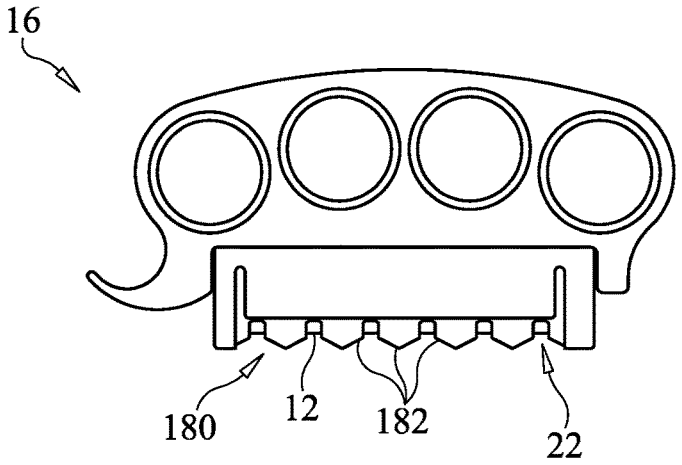
FIG. 9 is a side view of a sixth exemplary embodiment of a razor comb hair tool of the present disclosure, having a second alternative set of comb teeth.
Figure 10:
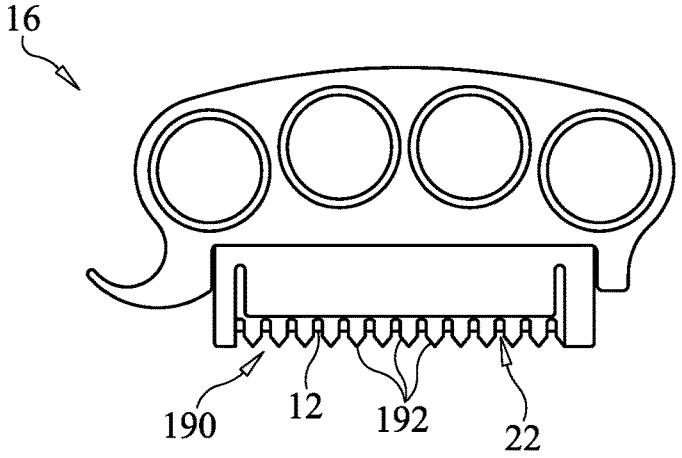
FIG. 10 is a side view of a seventh exemplary embodiment of a razor comb hair tool of the present disclosure, having a third alternative set of comb teeth.

Any of the various handles (e.g. handles 24, 132, 152, 162, or 206) may be used with any of the various blade guards (e.g. blade guard 14, 170, 180, 190, 204, 270, 272, 274). For example, as shown in FIG. 8, an alternative blade guard 170 may be releasably received by the retainer 16 and/or handle 24 in a manner similar to that described above. The alternative blade guard 170 may include a first alternative set of comb teeth 172. FIGS. 9 and 10 depict additional embodiments with alternative blade guards 180, and 190, for instance.

FIGS. 18-23 provide additional views of the ornamental design of exemplary hair tool 200, substantially as shown and described herein. The design consists of the features of shape, ornamentation, and configuration of the article shown in the drawings It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A hair tool adapted to receive a razor blade, comprising:

an elongated guard member having an exterior with first and second opposing edges and a hollowed interior defining a cavity, the first edge includes a plurality of spaced apart comb teeth and the second edge includes an opening allowing access to the cavity for receiving the razor blade; and a handle member having a first edge defining a socket that is open along the first edge and a first end, and is closed on a second end; and wherein;

the second edge of the guard member includes a raised portion defining a tenon shaped structure to be slidably received by the socket and the raised portion defining the opening to the cavity;

the opening includes an indentation exposing a portion of sides along an edge of the razor blade opposite a cutting edge for retrieving the razor blade from the cavity;

a protrusion is provided on the raised portion to restrict sliding movement between the handle member and the guard member at a fully assembled relative position, thereby resisting accidental disassembly; and the connection of the handle member and guard member obstructs access to the opening.

2. The hair tool of claim 1, wherein the handle member endwise slidably makes the connection with the second edge of the guard member.

3. The hair tool of claim 1, further comprising a razor blade positioned inside the cavity, and wherein the cavity is defined by the guard member so that the razor blade is releasably inserted sharpened edge first into the cavity.

4. The hair tool of claim 3, wherein:

the cavity extends and opens into a length of a base of the spaced apart comb teeth and the spaces defined between the spaced apart comb teeth; and a cutting edge of the razor blade is aligned with and extends between the spaced apart comb teeth.

5. The hair tool of claim 3, wherein the connection between the handle member and the guard member fully encases the razor blade.

6. The hair tool of claim 1, wherein the handle member includes a plurality of finger receiving openings defined therethough.

7. The hair tool of claim 6, wherein the plurality of finger receiving openings are laterally centered on the guard member.

8. The hair tool of claim 1, wherein a metal insert is coupled to the handle member along a second edge.

9. The hair tool of claim 1, wherein the handle member also includes a curved protrusion for separating hair.

10. The hair tool of claim 1, wherein after the connection is made, opposite end sections of the guard member are flush with respective opposite ends the handle member, the opposite ends located adjacent the ends of the receiving edge of the handle member after the connection is made.

* * * * *